United States Patent [19]

Tsubata et al.

[11] Patent Number: 4,744,133

[45] Date of Patent: May 17, 1988

[54] FLUID-TIGHT SLIDE FASTENER STRINGER

[75] Inventors: Noritaka Tsubata, Uozu; Koichi Tanikawa, Toyama; Kozo Watanabe, Kurobe, all of Japan

[73] Assignee: Yoshida Kogyo K. K., Tokyo, Japan

[21] Appl. No.: 24,531

[22] Filed: Mar. 11, 1987

[30] Foreign Application Priority Data

Mar. 14, 1986 [JP] Japan ..... 61-37979[U]
Mar. 18, 1986 [JP] Japan ..... 61-39607[U]

[51] Int. Cl.[4] ..... A44B 19/32
[52] U.S. Cl. ..... 24/389; 24/414
[58] Field of Search ..... 24/389, 410, 414, 384, 24/392, 393, 395

[56] References Cited

U.S. PATENT DOCUMENTS

| | | | |
|---|---|---|---|
| 2,075,762 | 3/1937 | Kelley | 24/414 |
| 2,791,017 | 5/1957 | Mulka | 24/389 |
| 3,114,953 | 12/1963 | Doelter . | |
| 3,490,109 | 1/1970 | Heimberger . | |
| 4,275,467 | 6/1981 | Doelter | 24/389 |
| 4,312,102 | 1/1982 | Fukuroi | 24/389 |
| 4,348,789 | 9/1982 | Brown | 24/414 |
| 4,488,338 | 12/1984 | Takahashi | 24/389 |
| 4,513,482 | 4/1985 | Fukuroi | 24/389 |

FOREIGN PATENT DOCUMENTS

| | | | |
|---|---|---|---|
| 0796468 | 10/1968 | Canada | 24/389 |
| 2500924 | 7/1976 | Fed. Rep. of Germany . | |
| 30130 | 1/1955 | Japan . | |
| 57-128106 | 8/1982 | Japan . | |
| 58-181211 | 12/1983 | Japan . | |
| 59-93208 | 6/1984 | Japan . | |
| 59-93209 | 6/1984 | Japan . | |
| 59-51805 | 12/1984 | Japan . | |

*Primary Examiner*—Victor N. Sakran
*Attorney, Agent, or Firm*—Hill, Van Santen, Steadman & Simpson

[57] ABSTRACT

A fluid-tight slide fastener stringer has a fluid-tight tape chiefly made of rubber or synthetic resin on which tape a series of discrete coupling elements are supported along an inner longitudinal margin of the tape. The tape margin is folded so as to provide therealong a pair of spaced contact portions and a folded edge portion disposed between the contact portions. The tape has a foamed layer extending in and through at least the contact portions and the folded edge portion. At least the margin of the resultant tape is excellent in ability of restitution, causing an improved fluid-tightness between the opposed stringers.

4 Claims, 3 Drawing Sheets

FLUID-TIGHT SLIDE FASTENER STRINGER

BACKGROUND OF THE INVENTION

1. Field of the invention:

The present invention relates generally to slide fasteners, and more particularly to a fluid-tight (airtight and watertight) slide fastener suitable for wet suits, life preservers, etc.

2. Description of the Prior Art:

U.S. Pat. No. 2,791,017, issued May 7, 1957 to F. Mulka, and U.S. Pat. No. 4,348,789, issued Sep. 14, 1982 to Brown, show a fluid-tight slide fastener of the type in which an inner longitudinal edge portion of each of opposed fluid-tight tapes is folded so as to extend around base portions of successive I-shaped coupling elements and in which successive C-shaped clamping strips surround, in clenched form, the folded edge portion over the base portion of the respective coupling element. The fluid-tight tape is relatively thick and is chiefly composed of rubber or synthetic resin having a certain degree of rigidness which is required for stable attachment of the coupling elements to the tape.

A problem with the known fluid-tight slide fastener is that smooth movement of a slider is difficult to achieve, partly because of such thick and rigid tape, and partly because the folded edge portion of the tape tends to restore its initial unfolded shape due to its own resilience.

Further, because of the rigidness of the tape, intimate contact between the opposed tapes at their contact portions contiguous to the respective folded edge portions can be impaired when lateral pulling forces are exerted on the tapes while the slide fastener is closed.

SUMMARY OF THE INVENTION

It is therefore an object of the present invention to provide a fluid-tight stringer for slide fasteners suitable for wet suits, life preservers and the like.

Another object of the invention is to provide a fluid-tight slide fastener stringer in which a fluid-tight tape has adequate softness and elasticity at least around its inner longitudinal margin including a folded edge portion and contact portions, thus causing not only smooth movement of a slider, but also an improved fluid-tightness between the opposed stringers.

According to the present invention, a fluid-tight slide fastener stringer has a fluid-tight tape chiefly made of rubber or synthetic resin on which tape a series of discrete coupling elements are supported along an inner longitudinal edge portion of the tape. The tape margin is folded so as to provide therealong a pair of spaced contact portions and a folded edge portion disposed between the contact portions. The tape has a foamed layer extending in and through at least the contact portions and the folded edge portion.

Many other advantages, features and additional objects of the present invention will become manifest to those versed in the art upon making reference to the detailed description and the accompanying drawings in which certain preferred structural embodiments incorporating the principles of the present invention are shown by way of illustrative example.

DETAILED DESCRIPTION

Figure 1:
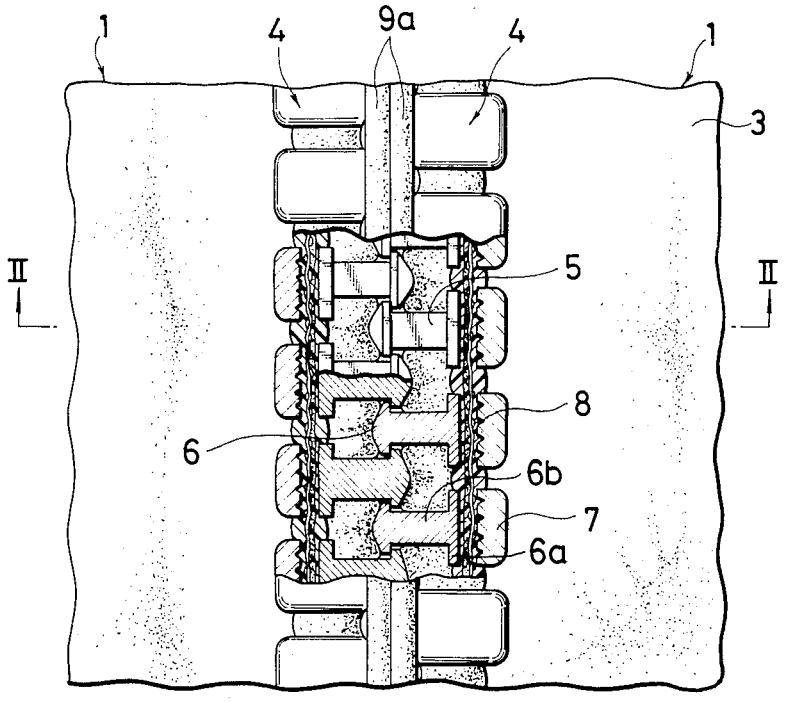
FIG. 1 a fragmentary plan view, partially in cross section, of a pair of interengaged fluid-tight slide fastener stringers each embodying the present invention.

FIG. 1 shows a pair of opposed fluid-tight slide fastener stringers 1, 1 each having a fluid-tight tape 3.

Figure 2:
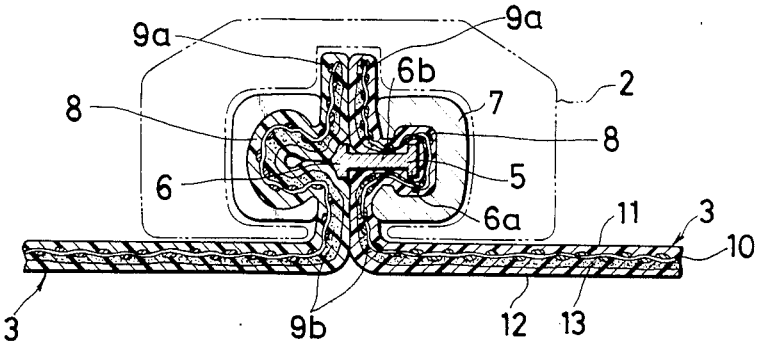
FIG. 2 is a transverse cross-sectional view taken along line II—II of FIG. 1.
Figure 3:
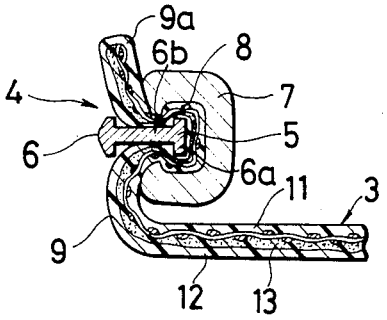
FIG. 3 is a transverse cross-sectional view of one of the stringers of FIG. 2, showing the posture of the stringer as the opposed stringers are uncoupled.
Figure 4:
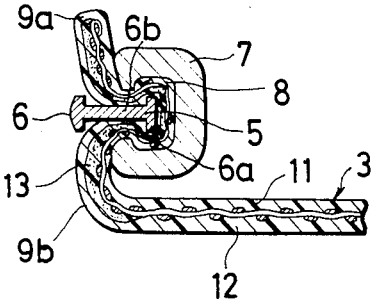
FIG. 4 is a view similar to FIG. 3, showing a modified fluid-tight slide fastener stringer.

As better shown in FIGS. 2 and 3, the tape 3 has an inner longitudinal margin 4 folded long its entire length so as to provide a folded portion 8 adjacent the margin and two contact portions (hereinafter referred to as "first and second contact portions) *9a*, *9b* disposed one on each side of the portion 8 and contiguous thereto. The first and second contact portions *9a*, *9b* are laterally (vertically in FIGS. 2 and 3) spaced from each other.

A series of discrete coupling elements 5 is mounted on and along the folded portion 8 of each tape 3. Each of the coupling elements 5 has a generally horizontal I-shaped cross section having a base portion *6a*, a leg portion *6b*, and a head portion 6. The folded portion 8 of the tape 3 extends around the base portion *6a* of each coupling element 5. A series of generally C-shaped clamping strips 7 is also mounted in clenched form on and along the folded portion 8 of the tape 3, each clamping strip 7 surrounding the folded portion 8 of the tape 3 over the base portion *6a* of a respective one of the coupling elements 5. The series of coupling elements 5 of one stringer 1 is engageable with the series of coupling elements 5 of the other stringer 1 by pulling a slider 2 which is mounted on the opposed stringers 1, 1 for movement along the two series of coupling elements 5 to open and close the slide fastener. When the opposed series of coupling elements 5, 5 are coupled together, the first and second contact portions *9a*, *9b* of one stringer 1 are pressed against the first and second contact portions *9a*, *9b*, respectively, of the other stringer 1 to effect a fluid-tightness between the opposed stringers 1, 1.

The tape 3 includes a core or ground fabric 10 of textile material, front and rear fluid-tight layers 11, 12 of elastic rubber or synthetic resin wholly covering front and rear surfaces, respectively, of the ground fabric 10. Preferably, the ground fabric 10 is woven or knit of substantially non-stretchable warp threads and stretchable weft threads.

Most important, the tape 3 also includes a spongy or foamed layer 13 of rubber or synthetic resin in the rear fluid-tight layer 12 extending on the fabric 10 along its entire width. Alternatively, the foamed layer 13 may extend through only the first and second contact portions *9a*, *9b* and the folded edge portion 8.

FIGS. 5A, 5B, 5C and 5D show various typical structures of the fluid-tight tape 3. In the tape structure of FIG. 5A, the foamed layer 13 is disposed in the rear fluid-tight layer 12 in contact with the rear surface of the fabric 10. In the tape structure of FIG. 5B, the formed layer 13 is disposed in both the front and rear fluid-tight layers 11, 12 in contact with both the front and rear surfaces of the fabric 10. In the tape structure of FIG. 5C, the foamed layer 13 occupies both the front and rear fluid-tight layers 11, 12. In the tape structure of FIG. 5D, the foamed layer 13 occupies only the rear fluid-tight layer 12.

Figure 5A:
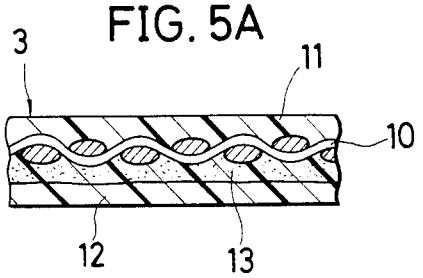
FIGS. 5 5B, 5C and 5D are fragmentary cross-sectional views showing various fluid-tight tapes.
Figure 5B:
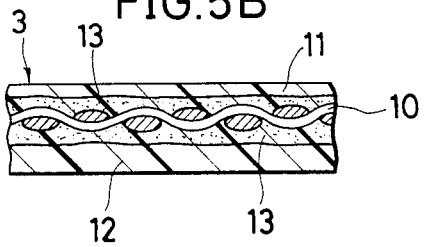
Figure 5C:
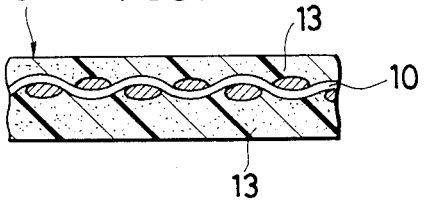
Figure 5D:
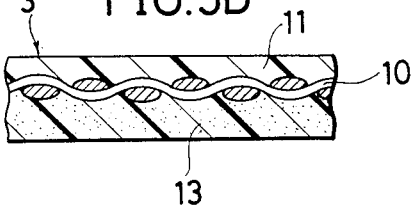

In the examples of FIGS. 5A and 5B, the foams in the foamed layer 13 may be either continuous or independent. But in the examples of FIGS. 5C and 5D, in which the foamed layer 13 is exposed to the exterior surface of the tape 3, the foams should be independent so that leakage of water through the foams is prevented.

The material for the front and rear fluid-tight layers 11, 12 and the foamed layer 13 may comprise rubber, or synthetic resin such as polyvinyl chloride and polyurethane.

The fluid-tight slide fastener stringer 1 thus constructed is advantageous in that because of the foamed layer 13, it is possible to increase the softness and elasticity of the contact portions *9a*, *9b* of the fluid-tight tape 3, thus causing smooth movement of the slider 2 for opening and closing the slide fastener.

Another advantage of the stringer 1 is that since the foamed layer 13 is excellent in ability of restitution, intimate contact between the contact portions of the opposed fluid-tight tapes 3,3 can be prevented from being impaired when great lateral pulling forces are exerted on the tapes 3, 3 while the slide fastener is closed, thus causing an improved degree of fluid-tightness.

Further, since the foamed layer 13 can be compressed to a relatively large extent such that the individual clamping strips 7 bite into the fluid-tight tape 3 as they are clenched on the folded edge portion 8 of the tape 3 around the base portions *6a* of the coupling elements 5, firm attachment of the coupling elements 5 to tape 3 is accomplished.

Although various minor modifications may be suggested by those versed in the art, it should be understood that we wish to embody within the scope of the patent granted hereon, all such embodiments as reasonably and properly come within the scope of our contribution to the art.

What is claimed is:

1. A fluid-tight slide fastener stringer comprising:

(a) a fluid-tight tape including a ground fabric of textile material as a core, and front and rear fluid-tight layes of elastic material covering front and rear surfaces of said ground fabric;

(b) a series of discrete coupling elements mounted on said tape along an inner longitudinal margin thereof, each of said coupling elements having a generally I shape having a base portion, a leg poriton and a head portion;

(c) said inner longitudinal margin of said tape being folded so as to provide therealong first and second contact portions engageable with corresponding first and second portions of a fluid-tight tape of a like companion stringer to effect a fluid-tightness between such two tapes, and a folded portion disposed between said first and second contact portions and extending around said base portion of each of said coupling elements;

(d) a series of generally C-shaped clamping strips each surrounding in clenched form said folded portion of said tape over said base portion of a respective one of said coupling elements; and (e) said tape having a formed layer as a component of said elastic material extending in and through at least said first and second contact portions and said folded portion, said foamed layer being disposed at least in said rear fluid-tight layer at an inner side thereof in contact with said rear surface of said fabric.

2. A fluid-tight slide fastener stringer according to claim 1, said foamed layer being disposed in both said front and rear fluid-tight layers at the respective inner side thereof in contact with said front and rear surfaces of said fabric.

3. A fluid-tight slide fastener stringer according to claim 1, wherein the foams in said foamed layer are continuous layers.

4. A fluid-tight slide fastener stringer according to claim 1, wherein the foams in said foamed layer are independent layers.

* * * * *